US005839950A

United States Patent [19]

Johansson Edling et al.

[11] Patent Number: 5,839,950

[45] Date of Patent: Nov. 24, 1998

[54] PORTABLE POWER GRINDER

[75] Inventors: Jan Krister Johansson Edling, Älvsjö; Sten Herman Olsson, Enskede, both of Sweden

[73] Assignee: Atlas Copco Tools AB, Nacka, Sweden

[21] Appl. No.: 846,843

[22] Filed: May 1, 1997

[30] Foreign Application Priority Data

May 7, 1996 [SE] Sweden ..... 9601735

[51] Int. Cl.[6] ..... B24B 13/20

[52] U.S. Cl. ..... 451/359; 451/344; 451/360

[58] Field of Search ..... 451/359, 360, 451/344, 353, 357

[56] References Cited

U.S. PATENT DOCUMENTS

| | | | |
|---|---|---|---|
| 3,210,892 | 10/1965 | Perham . | |
| 3,783,729 | 1/1974 | Parr . | |
| 4,655,006 | 4/1987 | Block . | |
| 4,773,120 | 9/1988 | Wang | 451/359 |
| 5,058,909 | 10/1991 | Rudolf et al. | 451/359 |
| 5,088,242 | 2/1992 | Lubbering et al. | 451/359 |
| 5,138,735 | 8/1992 | Kusz et al. | 451/359 |
| 5,207,028 | 5/1993 | Timmons | 451/359 |
| 5,218,790 | 6/1993 | Huang | 451/359 |
| 5,718,621 | 2/1998 | Turley | 451/359 |

FOREIGN PATENT DOCUMENTS

| | | |
|---|---|---|
| 0 237 856 A2 | 9/1987 | European Pat. Off. . |
| 0 515 230 A2 | 11/1992 | European Pat. Off. . |
| 28 16 398 A1 | 10/1979 | Germany . |
| 372 946 | 12/1963 | Switzerland . |
| WO 94/26462 | 11/1994 | WIPO . |

*Primary Examiner*—Eileen P. Morgan
*Attorney, Agent, or Firm*—Frishauf, Holtz, Goodman, Langer & Chick

[57] ABSTRACT

A portable power grinder for operating a wheel type of grinding tool, comprising an output spindle (12) drivingly connected to a rotation motor (11) and provided with a threaded coaxial bore (23) for receiving a grinding tool clamping screw (24) and with a radial support flange (25) for backing the grinding tool when clamped to the output spindle (12). An easily exchangeable tool support element (28) is sandwiched between the grinding tool and the support flange (25) and is provided with a coaxial through opening (30) for the clamping screw (24) and a forwardly directed tubular neck portion (27) for centering cooperation with a corresponding opening in the grinding tool.

6 Claims, 2 Drawing Sheets

PORTABLE POWER GRINDER

BACKGROUND OF THE INVENTION

The invention relates to a portable power grinder, in particular a power grinder intended for operating a wheel type grinding tool and comprising a housing, a rotation motor, and an output spindle drivingly connected to the motor and formed with a coaxial threaded bore for receiving a grinding tool clamping screw and with a radial support flange for backing the grinding tool as the latter is mounted on the output spindle by means of the clamping screw.

A problem concerned with power grinders of this type is a successively impaired grinding tool guidance due to an inevitable mechanical wear of the support flange on the output shaft. This results in a less accurate rotation of the grinding tool and a less accurate result of the grinding tool operation.

Another problem related to the above type of power grinder is how to adapt the mounting means to different types of grinding tools.

The above mentioned problems are solved by the invention as it is defined in the claims.

BRIEF DESCRIPTION OF THE DRAWINGS

A preferred embodiment of the invention is described below with reference to the accompanying drawing figures.

DETAILED DESCRIPTION

Figure 1:
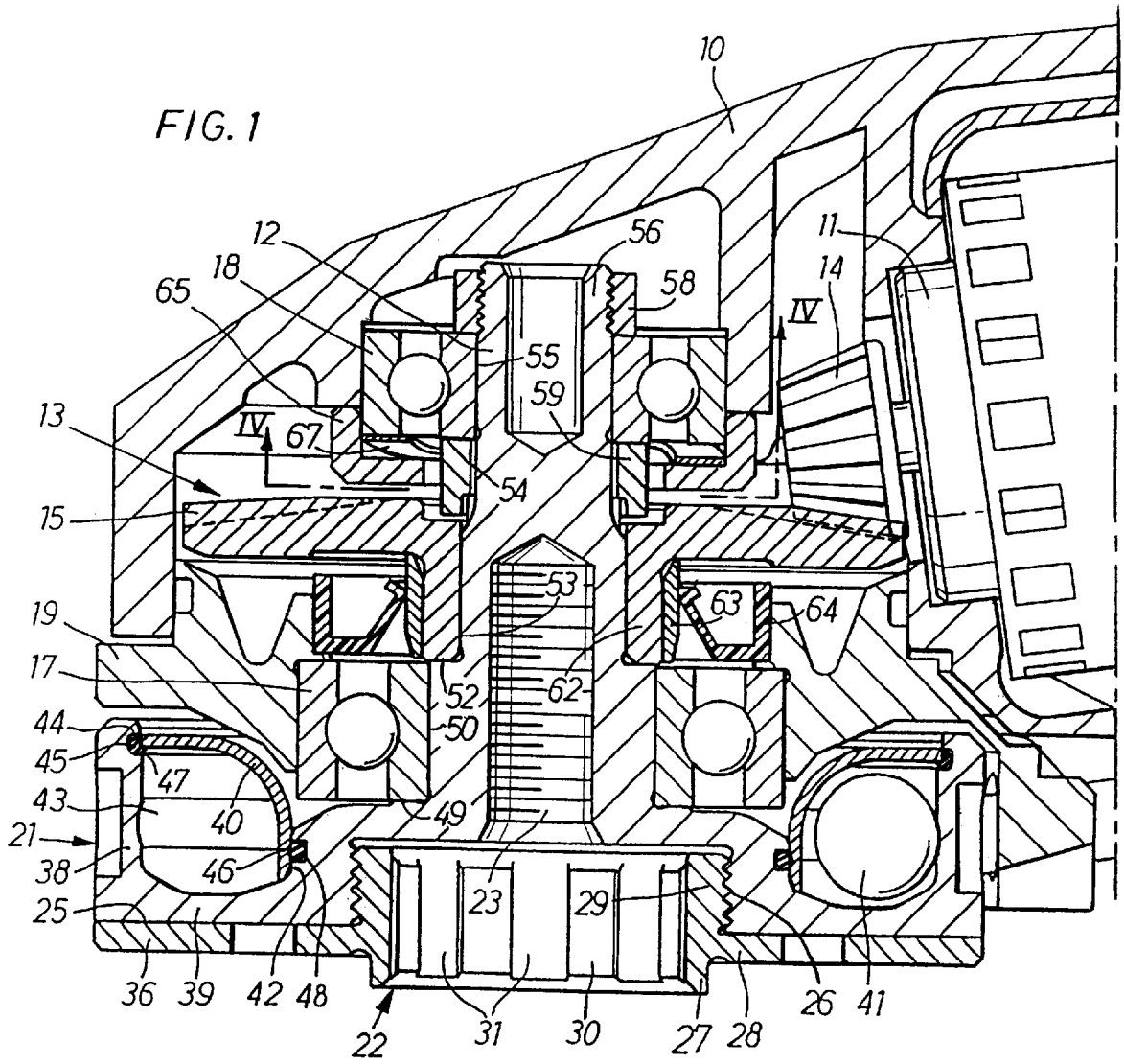
FIG. 1 shows a longitudinal section through the output end of an angle grinder according to the invention.
Figure 2:
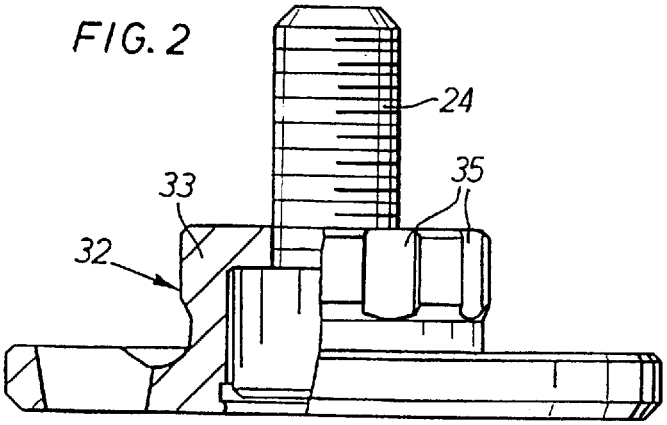
FIG. 2 shows a side elevation, partly in section, of a clamping element and a working implement clamping screw.

The power tool shown in the drawing figures is an angle grinder which comprises a housing 10, a rotation motor 11 and an output spindle 12. The latter is drivingly coupled to the motor 11 by means of an angle drive 13 which comprises a pinion 14 connected to the motor 11 and a bevel gear 15 connected to the output spindle 12. The output spindle 12 is journalled relative to the housing 10 by a forward ball bearing 17 and a rear ball bearing 18. The outer race of the forward bearing 17 is supported in a detachable wall section 19 of the housing 10.

At its forward end, the output spindle 12 is provided with an automatic ball type balancing device 21 and a mounting means 22 for a wheel type of grinding tool (not shown).

The grinding tool mounting means 22 comprises a threaded coaxial bore 23 in the output spindle 12 for receiving a clamping screw 24, a radial support shoulder 25, a threaded socket portion 26 coaxial with the bore 23, and a disc shaped grinding tool support element 28. The latter is formed with a rear threaded neck portion 29 for engagement with the socket portion 26. The pitch of this thread, however, is bigger than the pitch of the thread of the clamping screw 24, which means that the clamping screw 24 and the support element 28 can not be untightened in unison.

The support element 28 also comprises a forwardly directed tubular neck portion 27 for centering cooperation with a corresponding central opening in the grinding tool.

Figure 4:
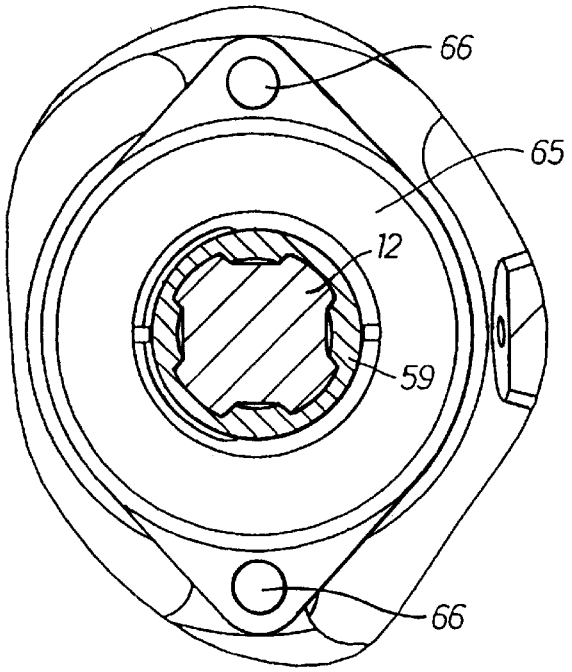
FIG. 4 shows a cross section along line IV—IV in FIG. 1.

Moreover, the support element 28 has a coaxial through opening 30 which is provided with axially directed splines 31. A clamping element 32 is arranged to cooperate with the clamping screw 24 to clamp the grinding tool against the support element 28. The clamping element 32 has a tubular neck portion 33 provided with splines 35 for cooperation with the splines 31 in the opening 30 of the support element 28. See FIG. 4.

Due to the locking action of the spline connection between the support element 28 and the clamping element 32 on one hand and due to the difference in pitch between the threads on the clamping screw 24 and the support element 28 on the other hand the grinding tool is prevented from comming loose as a result of any accidental relative rotation between the grinding tool and the output spindle 12.

The support element 28 is formed with a flat radial flange 36 which is intended to be sandwiched between the support shoulder 25 on the output spindle 12 and the grinding tool. The support shoulder 25 forms together with the support element 28 an axial backing means for the grinding tool as the latter is secured by tightening of the clamping screw 24.

When after some service time the support element 28 has become worn down to a certain extent it is easily exchanged by a new one. Without the employment of a separate support element 28, the shoulder 25 on the output spindle 12 itself would be subjected to the inevitable mechanical wear caused by the grinding tool. An exchange of the entire output spindle 12 would be a much more costly operation. The separate support element 28 also makes it possible to accomplish a simple adaptation of the mounting means 22 to differently shaped grinding tools.

The balancing device 21, which is intended to compensate for dynamic unbalance forces arrising in the grinding tool during its service life, comprises a circular peripheral wall 38, a transverse end wall 39, an annular closure member 40, and a number of steel balls 41 freely movable along the peripheral wall 38. For accurate guidance of the balls 41, the peripheral wall 38 is provided with an internal part-spherical contact surface 43 of a very high quality as regards centering visavi the rotation axis of the output spindle 12 and smoothness. This type of balancing device is previously known per se and is described in for instance GB 832 048.

In the power tool according to the invention, however, the transverse end wall 39 and the peripheral wall 38 are formed integrally with each other as well as with the output spindle 12, and the transverse end wall 39 forms the radial support shoulder 25 of the grinding tool mounting means 22.

Also formed in one piece with the output spindle 12 is a coaxial cylindrical surface 42 located radially inside the balls 41 and having a smaller axial extent than the peripheral wall 38.

Figure 3:
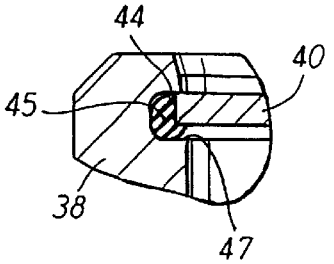
FIG. 3 shows a fractional section of the balancing device.

The annular closure member 40 has a substantially L-shaped cross sectional profile and is clamped by elastic expansion between the peripheral wall 38 and the cylindrical surface 42. For securing the closure member 40 in this position, the rear portion of the peripheral wall 38 is formed with an internal shoulder 44 for cooperation with the outer rim portion of the closure member 40, thereby locking the closure member 40 against rearward axial movement. See FIG. 3. O-rings 45, 46 are fitted in grooves 47, 48 in the peripheral wall 38 and the inner cylindrical surface 42, repectively, for sealing cooperation with the closure member 40.

Close to the end wall 39, the output spindle 12 is formed with a radial shoulder 49 and a cylindrical surface 50 for locating the inner ball race of the forward bearing 17. Since the diameter of the cylindrical surface 42 is bigger than the outer diameter of the bearing 17, it is possible to have the closure member 40 located partly outside the bearing 17. This means in turn that the forward end section of the output spindle 12, the balancing device 21 included, is axially very compact.

Further to the rear, the output spindle 12 comprises another radial shoulder 52, a cylindrical surface 53 for guidingly supporting the bevel gear 15, a spline portion 54, a further cylindrical surface 55 and a threaded portion 56. The rearmost cylindrical surface 55 supports guidingly the inner race of the rear bearing 18 and the threaded portion 56 is engaged by a clamping nut 58.

Figure 6:
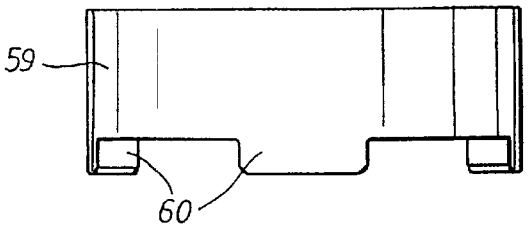
FIG. 6 shows, on a larger scale, a side elevation of the coupling element.

On the spline portion 54, there is supported an annular coupling element 59 which is formed with internal splines for driving connection with the spline portion 54 and with forwardly extending coupling teeth 60. See FIG. 6. The latters engage mating dog means 61 on the bevel gear 15 for transferring a driving torque between the bevel gear 15 and the coupling element 59.

The inner ball race of the rear bearing 18, the coupling element 59 and the bevel gear 15 are axially clamped to a rigid unit between the clamping nut 58 and the shoulder 52. By this arrangement it is made possible to use a light fit between the bevel gear 15 and the output spindle 12, which fascilitates dismantling of the output spindle assembly.

The bevel gear 15 is formed with a forwardly extending neck portion 62 on which is mounted a sleeve element 63 for cooperation with a seal ring 64 mounted in the housing 10. The purpose of the seal ring 64 is to prevent escape of the lubricating grease originally applied to the angle drive 13.

Figure 5:
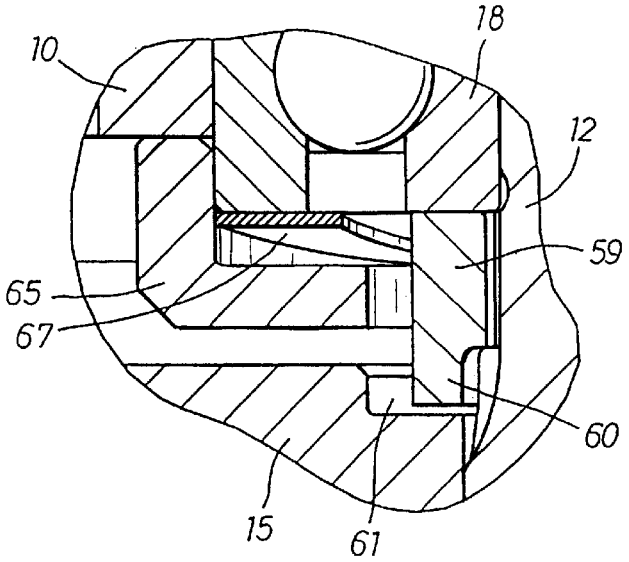
FIG. 5 shows, on a larger scale, a fractional section through the rear bearing and retaining means of the output spindle.

The output spindle 12 together with the rear bearing 18, the coupling element 59, the bevel gear 15 and the forward bearing 17 are axially clamped to the housing 10 by means of a retainer element 65 located beneath the rear bearing 18 and secured to the housing 10 by means of two screws 66. See FIG. 4. A clamping force is applied on the outer race of the rear bearing 18 by means of a washer type spring 67 inserted between the bearing 18 and the retainer element 65. See FIG. 5.

The axial clamping force exerted by the spring 67 is transferred to the output spindle 12 via the rear bearing 18 and further to the housing 10 via the output spindle 12, the forward bearing 17 and the wall section 19. By this arrangement there is obtained an axial pretensioning of the ball bearings 17, 18 such that the bearing plays are eliminated and the rotation accuracy of the output spindle 12 is very high.

We claim:

1. Portable power grinder for operating a wheel type grinding tool, comprising a housing (10), a rotation motor (11) and an output spindle (12) connected to said motor (11) and arranged to carry a grinding tool, said output spindle (12) being formed with a threaded coaxial bore (23) for receiving a grinding tool clamping screw (24) and with a radially extending support flange (25) for backing the grinding tool as the latter is attached to said output spindle (12), wherein said output spindle (12) is provided with an exchangeable grinding tool support element (28) attached to said support flange and comprising a radial flange (36) arranged to be sandwiched between the grinding tool and said support flange (25), a coaxial through opening (30) for said clamping screw (24) and a coaxial forwardly directed tubular neck portion (27) for centering engagement with a corresponding opening in the grinding tool.

2. Power tool according to claim 1, wherein said support element (28) is substantially disc shaped and comprises a coaxial rearwardly directed tubular neck portion (29) to be received in a corresponding socket portion (26) in said output spindle (12).

3. Power tool according to claim 1, wherein a clamping element (32) is disposed between said clamping screw (24) and the grinding tool, said clamping element (32) being formed with a tubular extension (33) having external axially directed splines (35), and said through opening (30) of said support element (28) is formed with axially directed splines (31) for engagement with said splines (35) on said tubular extension (33), said rearwardly directed tubular portion (29) of said support element (28) is provided with an outer thread for interengagement with a corresponding thread in said socket portion (26), said thread having a pitch different from the pitch of said threaded bore (23) and said clamping screw (24) to, thereby, form a lock device against accidental loosening of the grinding tool.

4. Power tool according to claim 3, wherein the pitch of said socket portion thread is bigger than the pitch of said clamping screw thread.

5. Power tool according to claim 2, wherein a clamping element (32) is disposed between said clamping screw (24) and the grinding tool, said clamping element (32) being formed with a tubular extension (33) having external axially directed splines (35), and said through opening (30) of said support element (28) is formed with axially directed splines (31) for engagement with said splines (35) on said tubular extension (33), said rearwardly directed tubular portion (29) of said support element (28) is provided with an outer thread for interengagement with a corresponding thread in said socket portion (26), said thread having a pitch different from the pitch of said threaded bore (23) and said clamping screw (24) to, thereby, form a lock device against accidental loosening of the grinding tool.

6. Power tool according to claim 5, wherein the pitch of said socket portion thread is bigger than the pitch of said clamping screw thread.

* * * * *